United States Patent [19]

Reimer

[11] 3,941,443

[45] Mar. 2, 1976

[54] ELECTRICAL TERMINAL SYSTEM

[75] Inventor: William A. Reimer, Wheaton, Ill.

[73] Assignee: GTE Automatic Electric Laboratories Incorporated, Northlake, Ill.

[22] Filed: Oct. 9, 1974

[21] Appl. No.: 513,355

[52] U.S. Cl. ..... 339/17 C; 339/22 B; 339/218 M

[51] Int. Cl.[2] ..... H01R 13/60

[58] Field of Search ..... 339/17 R, 17 CF, 17 C, 339/18, 19, 22 B, 218 B, 218 M, 222

[56] References Cited

UNITED STATES PATENTS

| | | | |
|---|---|---|---|
| 2,613,287 | 10/1952 | Geiger | 339/18 C X |
| 2,879,458 | 3/1959 | Schubert | 339/18 C X |
| 3,022,480 | 2/1962 | Tiffany | 339/18 R |
| 3,076,165 | 1/1963 | Weyrich | 339/17 C |
| 3,223,957 | 12/1965 | Cannon | 339/18 C |
| 3,299,393 | 1/1967 | Kelley et al. | 339/18 R |
| 3,649,953 | 3/1972 | Hoffman | 339/218 M X |
| 3,740,693 | 6/1973 | Gorman | 339/19 |
| 3,829,818 | 8/1974 | Iosue et al. | 339/19 |

*Primary Examiner*—Joseph H. McGlynn
*Assistant Examiner*—Craig R. Feinberg
*Attorney, Agent, or Firm*—David W. Heid

[57] ABSTRACT

This invention relates to an electrical terminal system capable of use with fully automated assembly equipment. The terminal system includes a circuit terminal projecting above a base on which a circuit connection may be made. A second terminal projects from an adjacent side of the base forming individual component terminals, providing a mounting point for individual discrete components. The base contains two opposing parallel rows of the terminals and components are mounted between two of such bases. A bus strap may be mounted on top of the base and is held in place by a set of grooves. Terminals extend from the bus strap and may be connected to the individual component terminals. Further an insulating bus may be used where multiple buses are employed.

3 Claims, 5 Drawing Figures

FIG. 2
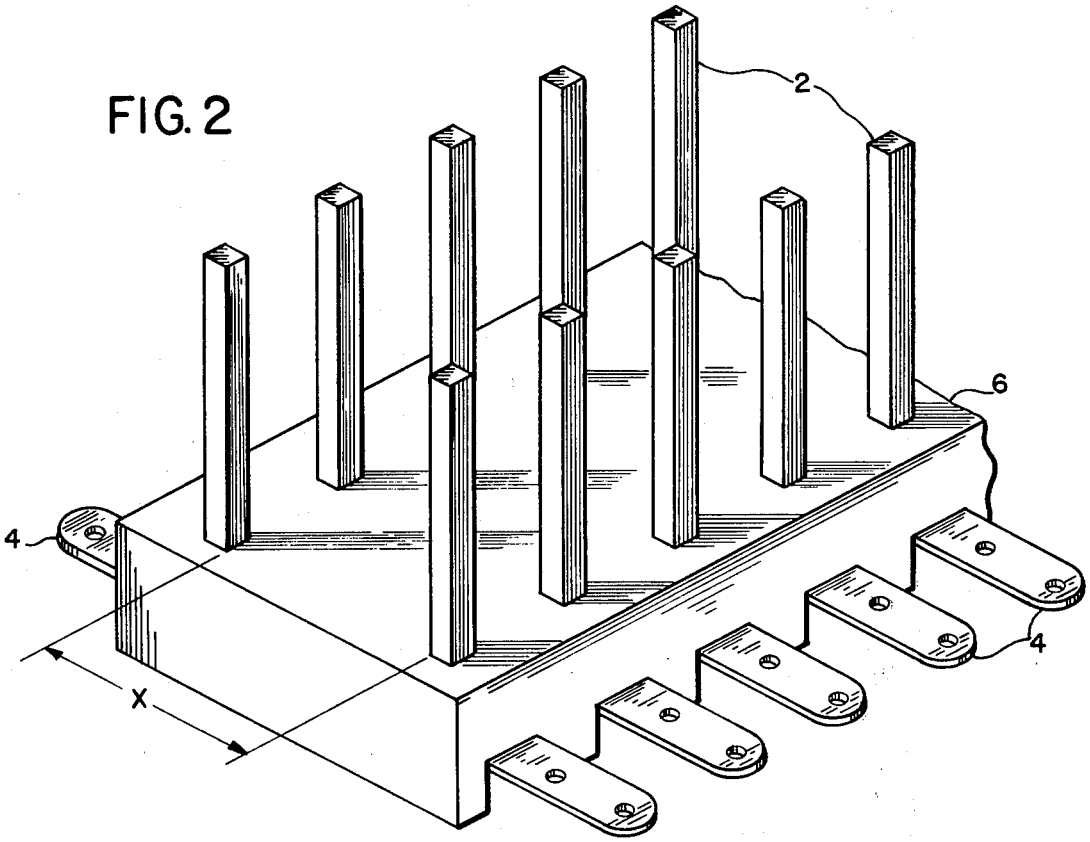
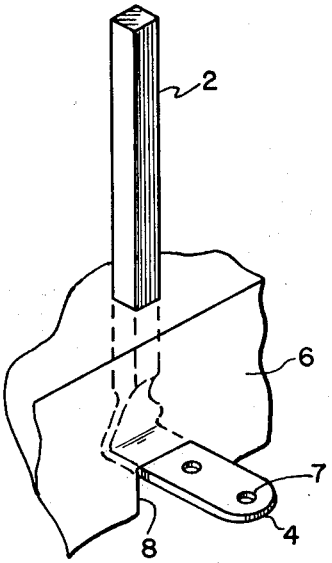
FIG. 1

ELECTRICAL TERMINAL SYSTEM

BACKGROUND OF THE INVENTION

1. Field of the Invention

The present invention relates to electrical terminals and more particularly to an electrical terminal allowing fully automatic assembly.

2. Description of the Prior Art

In most electrical systems the printed wiring card has become the primary means for mounting the individual components comprising the circuit. While the printed wiring cards are attractive in larger electronic systems in terms of volume production efficiency, packaging density and ease of component mounting, in systems utilizing a small number of cards, or large numbers of unique cards, are not especially attractive because of their high cost.

As an alternative to the use of printed wiring cards, individual terminals have been inserted into a dielectric terminal board to which circuit wires and the individual components are secured. The terminals are organized into rows and sometimes machine-tool distorted adjacent to the board to secure their positioning. While such an alternative is not as costly as the manufacturing of a unique printed wiring card, there are some serious disadvantages. In cases where the terminals are physically distorted to secure this position, they are not readily removable, and may distort the planar board they are inserted into. Further during the terminal placement, breaking and chipping of the board may result thereby requiring careful examination. Terminal board assemblies are expensive from the standpoint thay they are inflexible as to application since boards with different terminal spacing would be required to accommodate components of different sizes. Further the terminal boards do not readily provide the flexibility of individual component mounting and inherent physical limitations do not allow the component packaging densities attainable with printed wiring. Furthermore terminal boards do not readily adapt themselves to a bus strap. Typical prior art terminal boards are described in U.S. Pat. No. 3,116,099 which issued to I. M. Miller on Dec. 31, 1963; U.S. Pat. No. 2,533,483 to M. A. Losquadro issued Dec. 12, 1950; and U.S. Pat. No. 2,935,654 to V. S. Gittens et al which issued May 3, 1960.

OBJECTS AND SUMMARY OF THE INVENTION

From the foregoing discussion it will be understood that among the various objectives of the present invention are:

To provide a component terminating array allowing for flexibility in mounting space as required by variable sized components;

To provide a component terminating array capable of being used with automatic circuit processing equipment;

To provide a component terminating array block permitting circuit wiring and components mounting on the same side of the block;

To provide a component terminating block permitting the use of a common bus located on the block itself.

These and other objectives of the present invention are efficiently achieved by providing a component terminating block in which a plurality of electrically conductive circuit terminals project from one surface of the component terminating block. The circuit terminals extend below the surface of the block and either form or interconnect with the component terminals which extend outward from a surface orthogonally oriented in respect to the surface the circuit terminals projected from. Each component terminal contains a plurality of apertures through which individual component lead wires may pass and be secured to.

Two or more terminal blocks may be placed together with the components to be terminated between them. With the use of a plurality of component mounting apertures it is possible to establish multiple component mounting centers for any fixed spacing between two adjacent blocks.

The component body projects beyond the block surface from which the circuit terminal extends in order to minimize the volume required by the assembly.

This configuration is particularly well suited to be used with automated wiring machines and other automated means of assembly and the configuration may be altered to allow the use of other wiring methods as they are developed.

The foregoing as well as other objects, features and advantages of the present invention will become more apparent from the following detailed description taken in conjunction with the appended drawings.

BRIEF DESCRIPTION OF THE DRAWINGS

FIG. 1 shows a circuit and component terminating terminal geometry and placement within the component terminating block.

FIG. 2 is a perspective view showing a typical block with a plurality of terminals.

DESCRIPTION OF THE PREFERRED EMBODIMENT

Figure 3:
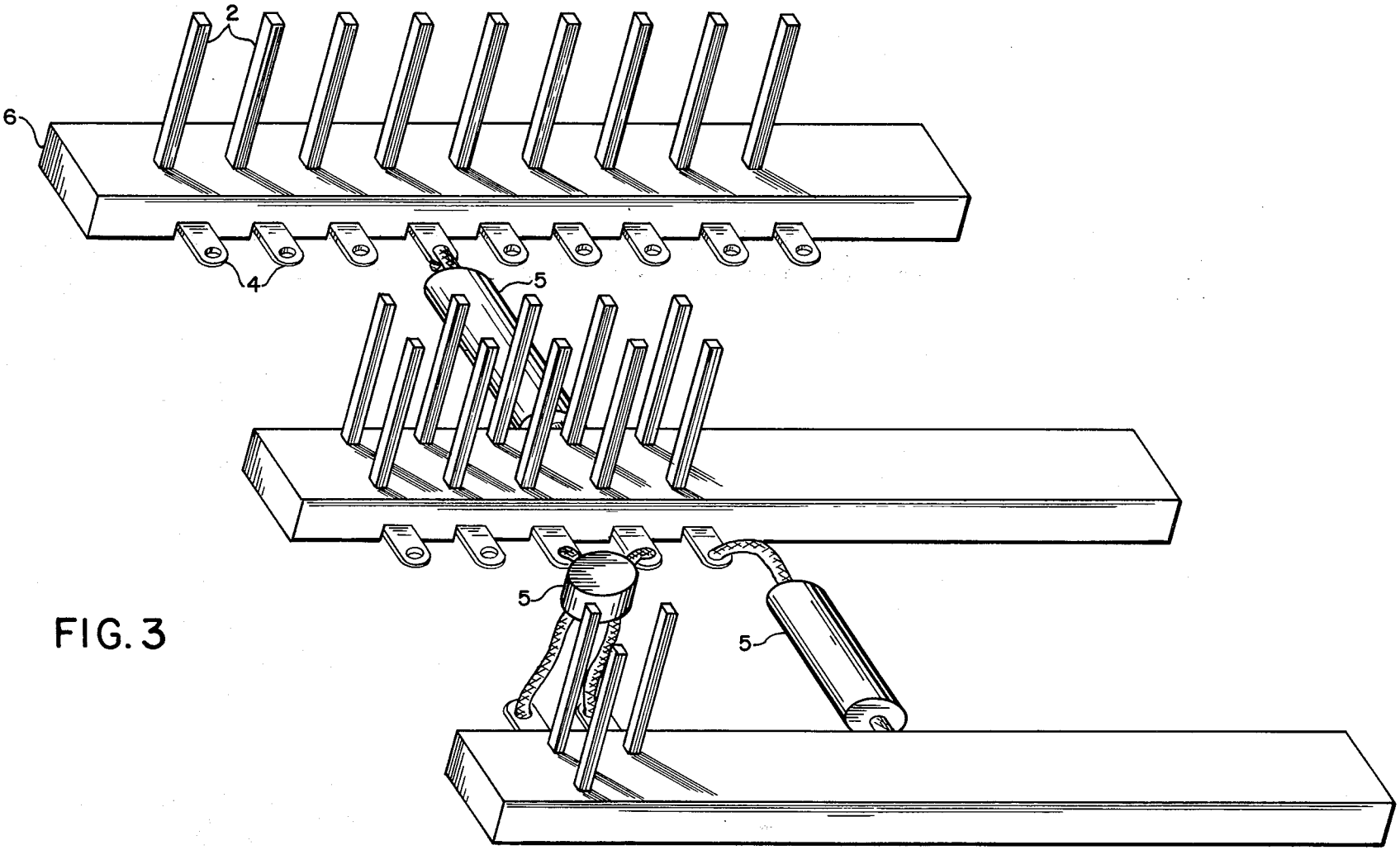
FIG. 3 shows an end view of a typical assembly.

With reference to FIG. 1, the electrically conductive circuit terminal 2 projects from the top of the block 6. The block 6 forms an insulator and may be formed from molded plastic. The electrically conductive component terminal 4 which may be formed to a flat strap either from the circuit terminal 2 or may be a strap which is affixed to the circuit terminal 2, projects from the side of the block 6 from a bottom recessed aperture 8. The component terminal 4 contains a plurality of apertures 7 through which the component leads passes and to which it is secured.

FIG. 2 shows a terminal block with a plurality circuit terminals 2 forming two parallel rows positioned in the block 6 with the component terminal 4 extending from the side of the block 6. A main wiring channel X is provided by the space on the top of the block 6 between the two parallel rows of circuit terminals 2.

FIG. 3 shows three component terminating blocks with individual components 5 mounted to the component terminating terminal 4.

Figure 4:
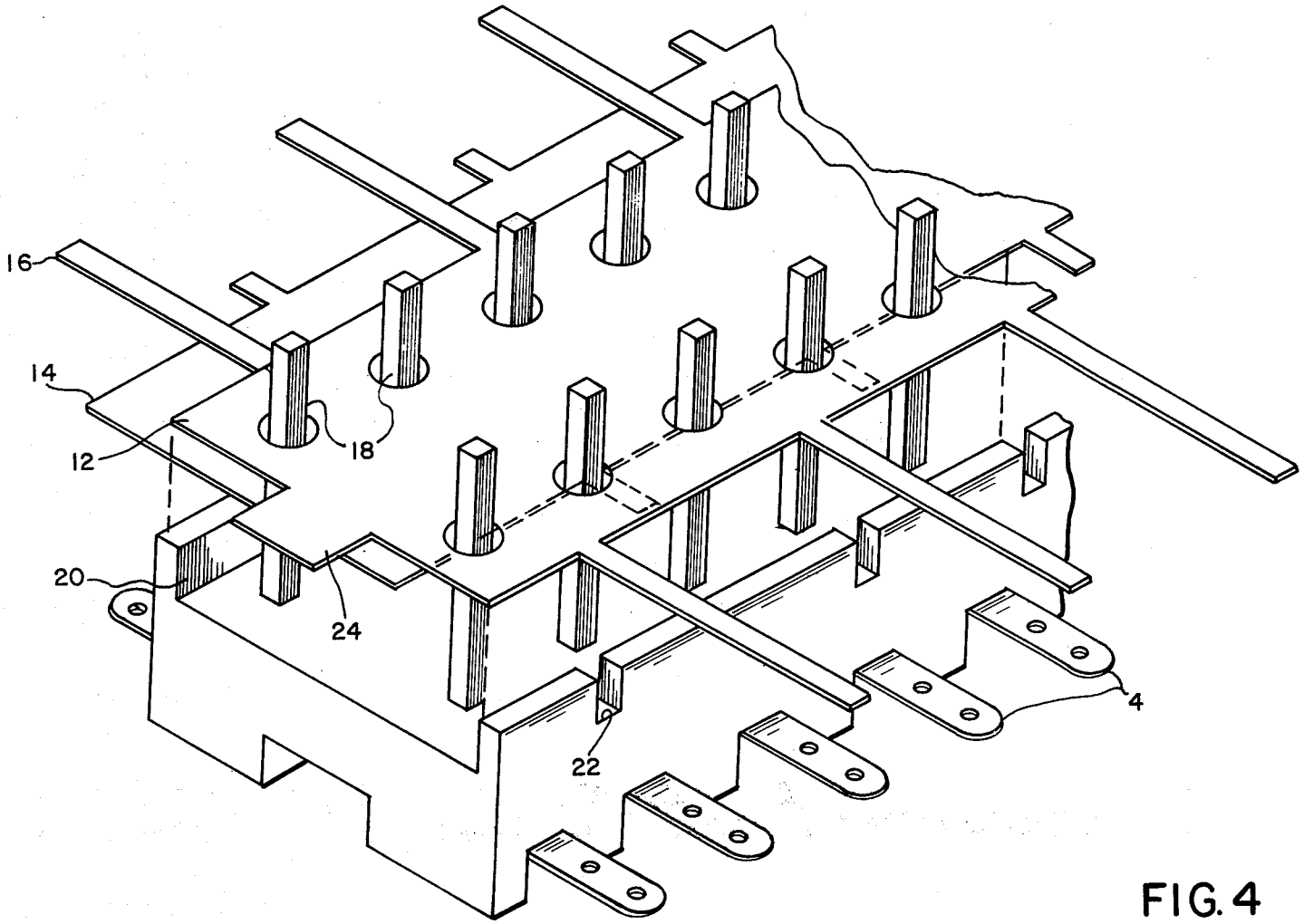
FIG. 4 is an exploded perspective view showing a component terminating block with a power bus and bus insulator.
Figure 5:
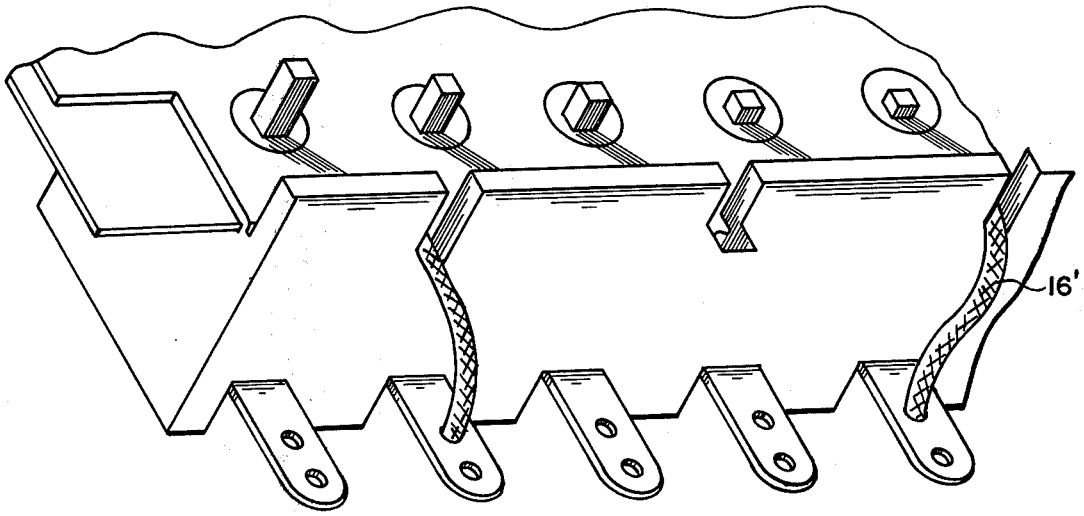
FIG. 5 is a perspective view of the bus making connection to the component terminating terminals.

The equivalent of a laminated power bus can be formed as exhibited in FIGS. 4 and 5. The bus 12 may be formed from a thin sheet of copper, and the bus terminals in the form of bars 16 (FIG. 4) or wires 16' (FIG. 5) which may be terminated to either of the adjacent component terminals 4. The block is provided with notches 22 which allows the bus terminals 16 or 16' to extend away from the block to the component terminals 4. The bus insulator 14 may be used when a number of bus units are to be placed over one another, however when only one bus is being used no insulator is necessary since the bus contains aperture 18 which allows the circuit terminals to pass through without coming into contact with it. Further, the component terminating block is provided with an indexing groove 20 in which the bus 12 and the bus insulator 14 are disposed and which holds them in fixed position with reference to the component terminating block.

From the foregoing it will be seen that the Applicant has provided an improvement in terminal blocks whereby the objectives set forth hereinabove are efficiently met. Since certain changes in the above-described construction will occur to those skilled in the art without departure from the scope of the invention it is intended that all matter contained in the preceding description or shown in the appended drawings shall be interpreted as illustrative and not in a limiting sense.

Having described what is new and novel and desired to secure by Letters Patent, what is claimed is:

1. Apparatus for terminating electrical componets, said apparatus comprising:

an electrically insulative block;

at least one electrically conductive terminal, said terminal disposed through through said insulative block, extending from a first face thereof to form a circuit terminal and from an adjacent face thereof to form a component terminal, whereby a circuit connection may be made to said circuit terminal and the component lead terminated at said component terminal;

wherein projecting from said first face of said block are parallel first and second rows of said circuit terminals, said second row of circuit terminals directly opposite said first row, said component terminals forming a first and second row, said first row of component terminals projecting from the respectively adjacent face of said first face containing said first row of said circuit terminals, said second row of component terminals projecting from the respective adjacent face of said second row of said circuit terminals; and further comprising circuit terminals comprising a metal bar to which said circuit connection may be made;

at least one aperture within said component terminals through which a component lead passes;

a bus strap, said bus strap comprised of electrically conductive material and positioned upon said first face of said block;

a plurality of apertures contained within said bus strap, which allows said circuit terminals to pass through said bus strap without making electrical contact with said bus strap;

an indexing groove, wherein said bus strap is positioned inside said indexing groove, said groove being used to position and secure said bus strap to said block;

a bus terminal, said bus strap comprising at least one of said bus terminal, said bus terminal extending outward from body of said bus strap; said block also containing at least one notch, said bus terminal passing through said notch and connected to said component terminals; and a bus insulator, said bus insulator constructed of electrically insulated material of the same size and shape of said bus strap, said bus insulator positioned between the faces of said bus strap, when a plurality of bus means are employed.

2. Apparatus for terminating electrical components as claimed in claim 1 wherein said component terminals comprise:

an extension of said circuit terminals, wherein said extension is flattened to form a flat strap and perpendicular to said circuit terminals.

3. Apparatus for terminating electrical components as claimed in claim 1 wherein said component terminals comprise:

a flat strap of electrically conductive material making an electrical connection to said circuit terminals.

* * * * *